United States Patent [19]

Seiichi et al.

[11] 4,100,721

[45] Jul. 18, 1978

[54] APPARATUS FOR TWISTING INSULATED CONDUCTORS FOR USE IN MULTICONDUCTOR COMMUNICATION CABLE INTO QUADS

[75] Inventors: Nishikawa Seiichi; Hasebe Shuji; Ohashi Kazuhiko; Kobayashi Shigeyuki; Maekawa Kazuyuki, all of Sakura, Japan

[73] Assignee: The Fujikura Cable Works, Ltd., Japan

[21] Appl. No.: 771,628

[22] Filed: Feb. 24, 1977

Related U.S. Application Data

[63] Continuation of Ser. No. 578,105, May 16, 1975, abandoned.

[30] Foreign Application Priority Data

Jun. 28, 1974 [JP] Japan ..... 49-73225
Jul. 29, 1974 [JP] Japan ..... 49-85988

[51] Int. Cl.[2] ..... H01B 13/02
[52] U.S. Cl. ..... 57/34 AT; 57/58.52; 242/128

[58] Field of Search ..... 57/34 AT, 58.3, 58.32, 57/58.36, 58.38, 58.52, 127.5, 127.7; 242/128

[56] References Cited

U.S. PATENT DOCUMENTS

| | | | |
|---|---|---|---|
| 1,956,730 | 5/1934 | Reichelt | 57/58.52 X |
| 2,773,344 | 12/1956 | Van Hook | 57/58.52 |
| 2,998,694 | 9/1961 | Haugwitz | 57/58.52 |
| 3,101,916 | 8/1963 | Haugwitz | 242/128 |
| 3,481,127 | 12/1969 | Vogelsberg | 57/34 AT |
| 3,507,108 | 4/1970 | Yoshimura et al. | 57/34 AT |
| 3,786,623 | 1/1974 | Eliasson | 57/58.52 X |

FOREIGN PATENT DOCUMENTS

| | | | |
|---|---|---|---|
| 262,408 | 9/1967 | Austria | 57/34 AT |

*Primary Examiner*—Richard C. Queisser
*Assistant Examiner*—Charles Gorenstein
*Attorney, Agent, or Firm*—Charles W. Helzer

[57] ABSTRACT

In a method and apparatus for twisting insulated conductors into quads, four insulated conductors are paid off from stationary bobbins, pretwisted alternately in the S and Z directions and thereafter twisted together into a star quad.

22 Claims, 5 Drawing Figures

APPARATUS FOR TWISTING INSULATED CONDUCTORS FOR USE IN MULTICONDUCTOR COMMUNICATION CABLE INTO QUADS

This is a continuation, of application Ser. No. 578,105 filed May 16, 1975, abandoned.

BACKGROUND OF THE INVENTION

This invention relates to a method and apparatus for twisting insulated conductors for use in multiconductor communication cables to form star quads, and more particularly to a method and apparatus for twisting four insulated conductors for use in multiconductor communication cables into star quads by pretwisting the insulated conductors.

Various methods of twisting insulated conductors for use in multiconductor communication cables into quads have been proposed in the past. One prior art method comprises the steps of mounting four supply bobbins of insulated conductors for use in multiconductor communication cables on a turn table driven by an electric motor, pretwisting the insulated cnductors paid off from the supply bobbins by means of an insulated conductors pay-off member which is used to drive a turn table by an electric motor when the insulated conductors are paid off, and then supplying the pretwisted insulated conductors to a twisting member. According to another prior art method four sets of insulated conductor pay-off members are provided each comprising supply bobbins and a rotary flyer which are mounted over a stationary floating table such thaat the insulated conductors are paid off from the supply bobbins via the rotary flyers and the rotary flyer is rotated about the supply bobbins on the stationary floating tables so as to pretwist twice times the insulated conductors paid off from respective supply bobbins. Then the pretwisted insulated conductors are sent to the twisting member to form a quad.

According to these methods, since the supply bobbins are rotated or the rotary flyer is rotatably mounted over the floating table for the purpose of providing pretwists to respective insulated conductors the mechanism for rotating the bobbins or rotary flyer is complicated thus limiting the rotating speed. Assuming now the V represent the running speed of respective insulated conductors and that P the pitch of the twist of quad, the revolutions N of the supply bobbin per unit time will be obtained by the expression $N = V/P$. It is understood from this expression that running speed V of the insulated conductors is NP, i.e. $V = NP$, and it depends on the number of revolution N and pitch P.

Pretwists are applied to the insulated conductors for the following reason. In a multiconductor communication cable comprising an assembly of a plurality of star quads each formed by twisting four insulated conductors it is necessary to reduce crosstalks caused by the capacitance unbalance between two pairs in a star quad. Especially, for the purpose of decreasing the capacitance unbalance between two pairs in a star quad it is advantageous to position respective insulated conductors on the apices of a square or a rhomb lying in the cross-section of the star quad. However, since the insulated conductors for use in multiconductor communication cables are generally prepared by extruding plastic coatings on cnductors by an extruder it is difficult to accurately position the conductors at the centers of the insulative coatings, in other words, to make the conductors and the insulative coatings to be in exact concentric relation. Thus, in an insulated conductor prepared in this manner, the conductor is slightly eccentric with respect to the center of the insulative coating, such eccentric condition continuing along the length of the insulated conductor. Where polyethylene is used as the insulation the plastic is often foamed to decrease the dielectric constant thereof. However, foaming is not uniform in the cross-section of the insulated conductor depending upon the conditions of the extruder. Sometimes, non-uniform foaming continues along the length of the insulated conductor. In this manner, where the conductor is eccentric with respect to the insulative coating or where the formed plastic coating contains nonuniformly distributed foams, even when four such deficient insulated conductors are twisted into a star quad in such a manner that respective insulated conductors will be positioned exactly on the apices of a square or a rhomb, the insulated conductors would not be positioned correctly on the apices of the square or the rhomb, or in certain cases, the dielectric constant between respective conductors would not be uniform. This causes an unbalance in the mutual capacitances between four pairs in a star quad. In other words, two circuits comprising a pair of conductors in a quad will be electrostatically coupled together and thus deteriorate the crosstalk characteristic of the cable.

To solve these problems a method of twisting in which pretwists are applied to the insulated conductors has been proposed. With this method even when the conductor is eccentric with respect to the plastic coating along the length of the insulated conductor or the formed insulative conductor is not uniform, as the positions of respective insulated conductors which face each other vary the eccentric condition of the conductors also varies along the length of the insulated conductors thus making more uniform the mutual capacitance between respective conductors with the result that the crosstalk characteristic is greatly improved than in a star quad without pretwist.

It has been accepted that in a twisted quad the pitch of the pretwist which is necessary to minimize the capacitance unbalance should be equal to the pitch of the quad. In recent years, for the purpose of improving the efficiency of twisting the insulated conductors it has been proposed to increase the size of the supply bobbins and the number of revolutions of the twisting apparatus. This renders it difficult to form a required number of pretwists to the paid off insulated conductor so that it has been obliged to sacrifice the production speed for giving pretwists of the desired member.

Further, in the prior art method of twisting insulated conductors into a quad as described above, it is necessary to rotate the supply bobbins of the insulated conductors and to surround the insulated conductor pay off bobbins with a rotary flyer. Hence, it has been impossible to exchange automatically the bobbins and to continuously pay off the insulated conductors.

SUMMARY OF THE INVENTION

Accordingly, it is the principal object of this invention to provide an improved method and apparatus capable of twisting insulated conductors into a star quad for use in multiconductor communication cables at high efficiencies.

Another object of this invention is to provide an improved method and apparatus for twisting the insulated conductors for use in multiconductor communication cables into star quads which is capable of forming a greater number of pretwists than the prior art method thereby rendering the mutual capacitance between conductors to be more balanced.

Still further object of this invention is to provide a novel method and apparatus for twisting the insulated conductors of multiconductor communication cables into star quads capable of continuously paying off the insulated conductors.

A further object of this invention is to provide a novel method and apparatus for twisting the insulated conductors of multiconductor communication cables into star quads which enable automatic exchange of bobbins wound with insulated conductors without stopping the twisting operation.

Still a further object of this invention is to provide an improved method and apparatus for twisting the insulated conductors of multiconductor communication cables into star quads which is capable of using larger pay-off bobbins than the prior art method and apparatus.

According to one aspect of this invention there is provided a method of twisting insulated conductors for use in multiconductor communication cables into star quads, characterized in that four pay-off bobbins respectively wound with insulated conductors are maintained at fixed positions, the insulated conductors paid off from respective pay-off bobbins are pretwisted alternately in the S and Z directions and thereafter the pretwisted insulated conductors are twisted together into a star quad.

According to another aspect of this invention there is provided apparatus for twisting insulated conductors for use in multiconductor communication cables into star quads, characterized in that said apparatus comprises insulated conductor pay-off apparatus including four sets of stationary pay-off bobbins respectively wound with the insulated conductors, pretwisting apparatus for applying pretwists to the insulated conductors paid off from the pay-off bobbins alternately in the S and Z direction and twisting apparatus for twisting together into a star quad the insulated conductors pretwisted by the pretwisting apparatus.

DESCRIPTION OF THE DRAWINGS

Further objects and advantages of the invention will be more fully understood from the following detailed description taken in conjunction with the accompanying drawings in which.

DESCRIPTION OF THE PREFERRED EMBODIMENTS

Figure 1:
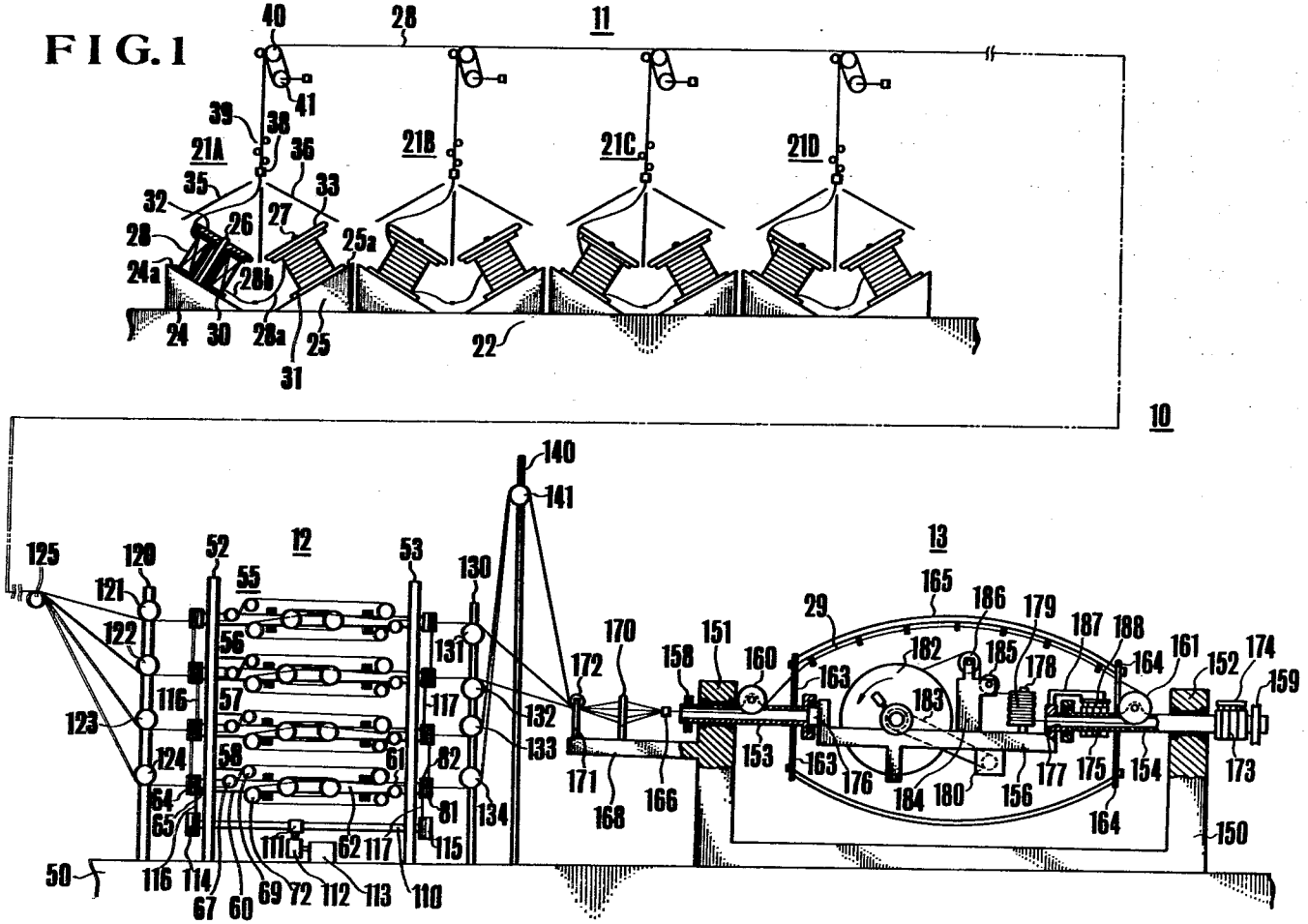
FIG. 1 is a schematic illustration of the basic construction of the twisting apparatus embodying the invention.

The twisting apparatus 10 shown in FIG. 1 comprises three essential apparatus, namely, insulated conductor pay-off apparatus 11, pretwisting apparatus 12 characterizing the invention and twisting apparatus 13, which will be described later in detail.

The insulated conductor pay-off apparatus 11 comprises four insulated conductor pay-off devices 21A, 21B, 21C and 21D which are mounted on a base 22. Since insulated conductor pay-off device 21A, 21B, 21C and 21D have the same construction, the insulated conductor pay-off device 21A alone will be described in detail. The pay-off device 21A includes two inclined bobbin stands 24 and 25 mounted on the base 22 with their inclined surfaces **24*a* and 25*a* faced with each other. Shafts 26 and 27 are secured to the centers of the inclined surfaces 24*a* and 25*a* at right angles with respect thereto for receiving bobbins 30 and 31, respectively, which are wound with insulated conductors 28 for manufacturing multiconductor communication cables. The bobbins 30 and 31 are removably secured to the inclined surfaces by suitable fixtures, not shown. The extensions of the axes of the shafts 26 and 27 intersect with each other. Rotatable guide rings 32 and 33 are removably secured to the top ends of the shafts 26 and 27, respectively. The purpose of the guide rings 32 and 33 is to frictionally engage and guide the insulated conductors 28** paid off from the bobbins forward upper surfaces while rotating thereby preventing damage of the insulated conductors.

Conical hoods 35 and 36 are disposed above guide rings 32 and 33 respectively. The top portions of the conical hoods 35 and 36 are open and the hoods are positioned with respect to the bobbins 30 and 31 such that the extensions of the axis of shafts 26 and 27 intersect at the openings at the top portions of the conical hoods. As shown in FIG. 2, the conical hoods 35 and 36 are joined together and a slot 37 is formed through the juncture for permitting the insulated conductor 28 to move from one hood to the other. As diagrammatically shown in FIG. 1, above the hoods 35 and 36 are disposed a guide ring 38, leveller rollers 39 for straightening and tensioning the insulated conductor, a braking roller 40 and a dancer roller 41 in the order mentioned.

Two bobbins 30 and 31 are juxtaposed for the purpose of continuously paying off the insulated conductor 28, thus firstly from bobbin 30 and then bobbin 31. More particularly, while the insulated conductor 28 is being paid off from one pay-off bobbin, for example bobbin 30, the other bobbin 31, used as a spare bobbin, wound with the insulated conductor is mounted on the shaft 27 and the leading end **28*a* of the insulated conductor 28 carried by the pay-off bobbin 31 mounted in this manner is spliced to the railing end 28*b* of the insulated conductor carried by the bobbin 30**. Such preparatory operation is repeatedly performed whenever the insulated conductor of one bobbin has been completely paid off. The exhausted bobbin may be removed and the leading end of the conductor on a fresh replacement bobbin spliced to the trailing end of the remaining bobbin to provide for continuous operation of the apparatus.

When the insulated conductor pay-off device is constructed as above described, the insulated conductor 28 paid off from bobbin 30, for example, passes above hood 35 through the guide ring 32. In this connection, the insulated conductor 28 contacts the guide rings 32 or 33 only at low speeds, whereas when the insulated conductor passes at high speeds the insulated conductor tends to bulge outwardly of the direction of rotation due to the ballooning effect caused by unwinding the insulated conductor from its supply bobbin so that the insulated conductor advances without engaging the guide ring 32 but engaging the hood 35 or 36 and guide ring 38. After passing through the opening at the top end of the conical hoods 35 or 36, the insulated conductor 28 passes to the twisting apparatus 12 via guide ring 38, leveller rollers 39, braking roller 40 and dancer roller 41 without being twisted by these elements. When the insulated conductor 28 of the bobbin 30 has been completely paid off, insulated conductor 28 wound on spare bobbin 31 is automatically paid off, at this time, the passage of the insulated conductor automatically is switched to hood 36 from hood 35 through the slot 37 at the juncture of hoods 35 and 36.

The pretwisting apparatus 12 comprises four pretwisting devices or units 55, 56, 57 and 58 which are supported by vertical frames 52 and 53 secured to base 50. The pretwisting devices 55 through 58 are constructed to pretwist all four insulated conductors 28 respectively paid off from the pay-off devices 21A, 21B, 21C and 21D at four different points within one revolution of each pretwisting device. The detail of the construction of one pretwisting device 58, for example, is shown in FIGS. 3 and 4.

Figure 3:
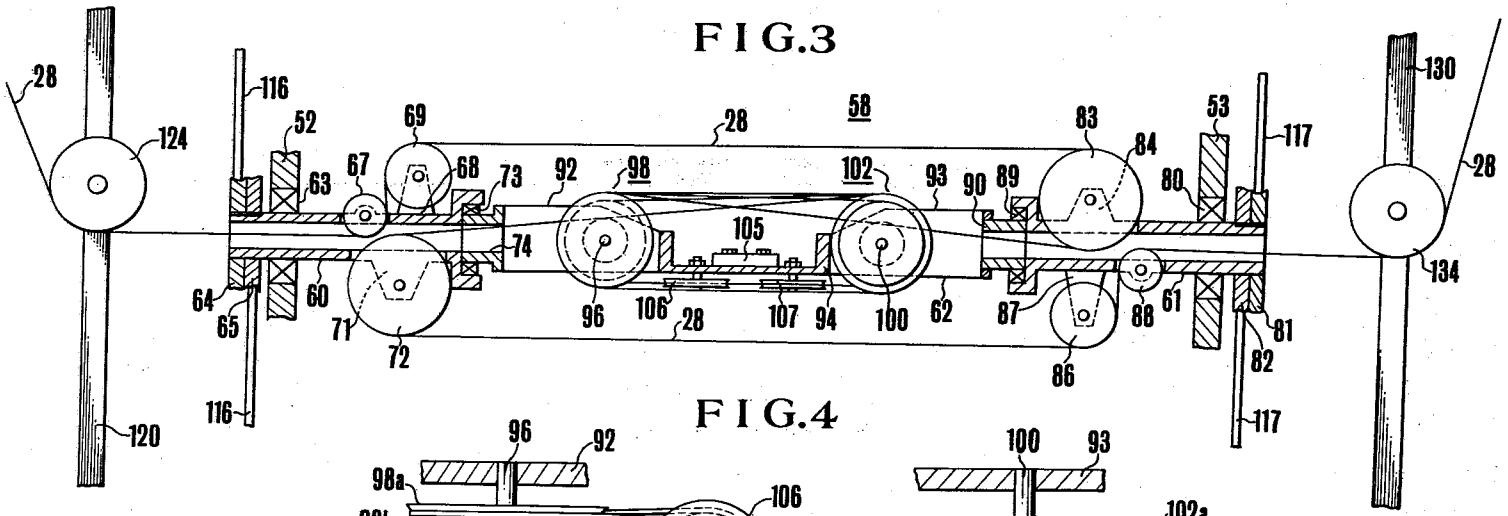
FIG. 3 is a longitudinal sectional view of one of the pretwisting devices shown in FIG. 1 taken along the axes of hollow rotary members.
Figure 4:
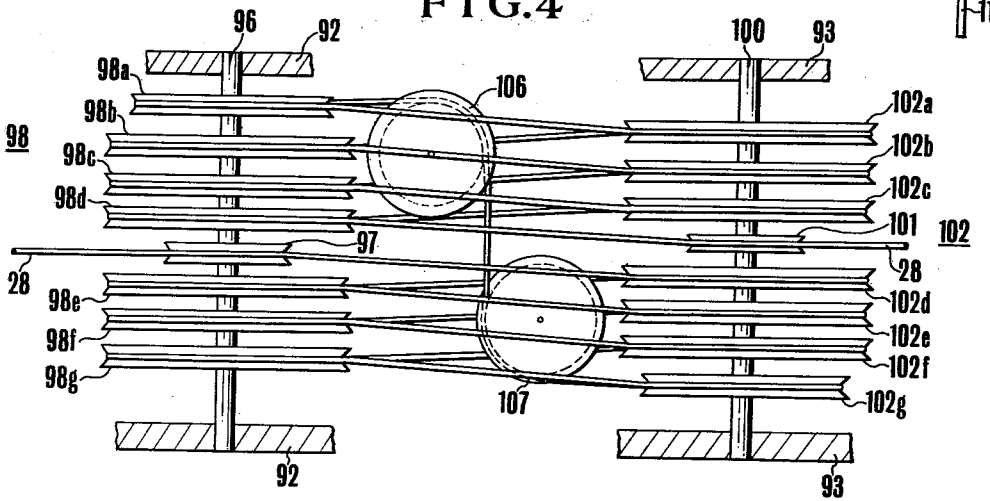
FIG. 4 is a longitudinal sectional view of one of the pretwisting devices showing essential elements of a wire accumulator necessary for giving pretwists.

As shown in FIGS. 3 and 4, the pretwisting device 58 comprises, as its essential elements, a fore rotary member 60, a rear rotary member 61 and a floating frame 62. The fore and rear rotary members 60 and 61 are spaced apart and disposed on a straight line, and the floating frame 62 is disposed between the fore and rear rotary members free to rotate with respect thereto.

The fore rotary member 60 takes the form of a hollow tube rotatably mounted on frame 52 through a bearing 63. Driving pulleys 64 and 65 are secured on the rotary member 60 on the outside of the frame 52. On the inner side of the frame 52 are mounted a first guide roller 67 with one portion protruded into the tubular rotary member 60, a second guide roller 69 supported close to the first guide roller 67 by a bracket 68 near the end of the fore rotary member 60 close to the floating frame 62 and a fourth guide roller 72 rotatably mounted on a bracket 71 on the side opposite to the first and second guide rollers 67 and 69. The end of the fore rotary member 60 close to the floating frame 62 is provided with a cup shaped flange for supporting the tubular end 74 of the floating frame 62.

The rear rotary member 61 has the same construction as the fore rotary member 60 and is rotatably supported by frame 53 through a bearing 80. Thus, the rear rotary member 61 comprises driving pulleys 81 and 82, a third guide roller 83 supported by a bracket 84, a fifth guide roller 86 supported by a bracket 87, and a cup shaped flange for supporting the tubular member 90 of the floating frame 62 through a bearing 89.

The floating frame 62 comprises two rectangular frames 92 and 93, a connecting plate 94 for interconnecting the frames 92 and 93, a tubular member 74 rotatably received in the cup shaped flange of the fore rotary member 60, and the tubular member 90 described above. The rectangular frame 92 is provided with a fore pivot pin 96 extending in the direction perpendicular to the axes of the fore and rear rotary members 60 and 61 for rotatably supporting a guide pulley 97 and a plurality of fore accumulating pulleys 98 on the opposite sides of the guide pulley 97, as shown in FIG. 4. In this example, there are provided seven accumulating pulleys 98*a* through 98*g*. Similarly, the rear rectangular frame 93 is provided with a rear pivot pin 100 extending in the direction perpendicular to the axes of the fore and rear rotary members 60 and 61 for rotatably supporting a guide pulley 101 and a plurality of rear accumulating pulleys 102 on both sides of the guide pulley 101 (in this example seven pulleys 102*a* through 102*g*). The numbers of the fore accumulating pulleys 98 and the rear accumulating pulleys 102 are the same and as shown in FIG. 4, pulleys 102 are shifted half step in the lateral direction with respect to pulleys 98. These pulleys 98 and 102 have a diameter slightly projecting beyond the lower edges of the rectangular frames 92 and 93. The connecting plate 94 is positioned slightly below the axes of the fore and rear rotary members 60 and 61 and a weight 105 is mounted on the connecting plate 94 so as to maintain the floating frame 62 in a stationary condition as the rotary members 60 and 61 rotate. Deflection rollers 106 and 107 are mounted on pins extending downwardly from the lower surface of the connecting plate 94.

Figure 2:
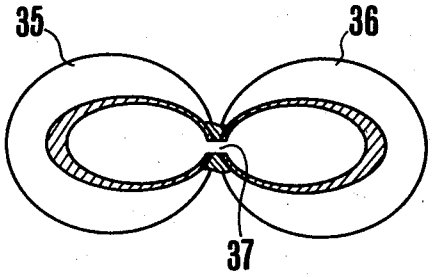
FIG. 2 is a sectional view of a paired hood viewed from upside to the pay-off bobbin utilized in the apparatus shown in FIG. 1.

As shown in FIG. 1, a plurality of pretwisting devices 55, 56, 57 and 58, each constructed as above described are arranged in the vertical direction between frames 52 and 53. Beneath the lowermost pretwisting device 58 is rotatably mounted a drive shaft 110 on the frames 52 and 53.

A gearing 111 is mounted near the central portion of the drive shaft 110 and the gearing 111 is connected to an electric motor 113 mounted on the base 50 through a control device 112 for controlling periodically the reversal of the drive which includes a reverse gearing, and a speed change device. In this manner, the direction of rotation of the drive shaft 110 is periodically reversed by the control device 112. Pulleys 114 and 115 are mounted on the ends of the drive shaft 110 projecting beyond the frames 52 and 53. These pulleys are coupled to the drive pulleys (pulleys 64, 65, 81 and 82 shown in FIG. 3) through belts 116 and 117.

To the left of the frame 52 which supports the pretwisting devices is disposed a plurality of inlet guide rollers 121 through 124 which are rotatably mounted on a post 120 secured to the base 50. These inlet guide rollers 121 are supported at positions corresponding to those of the pretwisting devices 55 through 58 mounted on the frames 52 and 53. To the left of the guide rollers 121 through 124 is provided another guide roller 125.

Further, as shown in FIG. 1, to the right of the frame 53 are disposed four outlet guide rollers 131, 132, 133 and 134 which are rotatably mounted on a post 130 secured to the base 50. Similar to the inlet guide rollers, rollers 131 through 134 are mounted at positions corresponding to those of the pretwisting devices 55 through 58. To the right of the outlet guide rollers 131 through 134 is provided a post 140 having a larger height tha the post 130 for rotatably mounting a shift roller 141 near the upper end of the post 140.

Respective insulated conductors 28 paid off from the pay-off devices 21A, 21B, 21C and 21D of the pay-off apparatus 11 are fed into respective pretwisting devices 55 through 58 via guide roller 125 and inlet guide rollers 121 through 124. For example, the insulated conductors 28 fed to the pretwisting device 58 from the pay-off device 21D passes through inlet guide roller 124, the fore rotary member 60 shown in FIG. 3 and the first guide roller 67 to the outside of the fore rotary member 60. Then the insulated conductor passes through the second guide roller 69, the third guide roller 83 of the rear rotary member 61, inside of the rear rotary member 61, the tubular member 90 on the righthand end of the frame 93 of the floating frame 62, and a guide pulley 101 to the pulley 98*d* of the four accumulating pulleys 98 mounted on the rectangular frame 92. As shown in FIG. 4, then the insulated conductor 28 passes successively around the rear accumulating pulleys 102 and the fore accumulating pulleys 98. Then the insulated conductor passes from the pulley 98*a* of the fore accumulating pulleys 98 through deflection rollers 106 and 107 to pulley 102*g* of the rear accumulating pulleys 102. Again, the insulated conductor passes successively around the fore accumulating pulleys 98 and the rear accumulating pulleys 102. From the pulley 102*d* of the rear accumulating pulleys 102, the insulated conductor 28 passes through the guide pulley 97 mounted on pin 96 supported by the rectangular frame 92 and through the tubular member 74 at the lefthand end of the frame 92 into the fore rotary member 60. Then the insulated conductor passes to the outside of the fore rotary member 60 around the fourth guide roller 72. From this roller, the insulated conductor passes into the rear rotary member 61 through the fifth guide roller 86 and the sixth guide roller 88. From the inside of the rear rotary member 61, the insulated conductor passes to the outlet guide roller 134. Other insulated conductors guided to the pretwisting devices 55, 56 and 57 from inlet guide rollers 121, 122 and 123 pass to the outlet guide rollers 131, 132 and 133 through similar passages.

While the insulated conductors pass through the pretwisting apparatus the reverse drive control device 112 periodically reverses the direction of rotation of the drive shaft 110. More particularly, supposing that the drive shaft 110 is driven in one direction, the torque of the shaft 110 is transmitted to the drive pulleys of respective pretwisting devices 55 through 58 via pulleys 114 and 115 and belts 116 and 117 for driving the fore and rear rotary members 60 and 61 in the same direction as the drive shaft 110. As the direction of rotation of the drive shaft 110 is reversed by the operation of the reverse drive control device 112, the direction of rotation of the fore and rear rotary members 60 and 61 is also reversed. Such alternate reversal of the direction of rotation of the fore and rear rotary members alternately applies to respective insulated conductors pretwists in the directions of S and Z.

In FIG. 3, during one revolution of the drive pulleys of 64, 65, 81 and 82 of the pretwisting device 58, as the floating frame 62 is held stationary, one pretwist is applied to the four portions of the insulated conductor respectively between the inlet guide roller 124 and the first guide roller 67, between the third guide roller 83 and the fore accumulating pulleys 98, between the rear accumulating pulleys 102 and the fourth guide roller 72 and between the sixth guide roller 88 and the outlet guide roller 134.

With regard to the directions of twisting of various portions with respect to the direction of rotation of the rotary members, it should be understood that the direction of twisting between the inlet guide roller 124 and the first guide roller 67 and the direction of twisting between the third guide roller 83 and the fore insulated conductor accumulating pulleys 98 are the same. Further, the direction of twisting between the rear accumulating pulleys 102 and the fourth guide roller 72, and the direction of twisting between the sixth guide roller 88 and the outlet guide roller 134 are the same while the direction of rotation of the rotary members 60 and 61 is maintained the same as above described but the direction of twistings of the last two portions are opposite to those of first said two portions. Accordingly, when the direction of rotation of the rotary members 60 and 61 is reversed when the insulated conductor is advanced a length equal to the length accumulated, a total of four pretwists are applied within such length. Similar pretwisting operations are also performed in other pretwisting devices 55, 56 and 57.

Denoting the number of revolutions per unit time of the fore and rear rotary members 60 and 61 by N and the running speed of the insulated conductors 28 by V and assuming that the direction of rotation of the rotary members 60 and 61 is reversed alternately each time the insulated conductors 28 advance a length corresponding to the accumulated length thereof, pretwists are applied to the insulated conductors alternately in the directions of S and Z at a pitch of V/4N for each accumulated length, which may be 50m for example. The period of switching the direction of pretwisting, that is the accumulated length of the insulated conductors is generally determined depending upon the electrical characteristics required for the multiconductor communication cables. However, too short period of pretwisting causes severe wear of the machine as well as loosening of twist. For this reason, a length of 50m is preferred. The numbers of the insulated conductor supported on accumulating pulleys 98 and 102 are determined in accordance with this length.

The strands 28 pretwisted in this manner are sent to the twisting apparatus 13 directly or via the shift roller 141 which is used for the purpose of shifting in the reversing point of the S and Z pretwists of the insulated conductors sent out from the pretwisting devices 57 and 58 with respect to the insulated conductors sent out from the back twisting devices 55 and 56, so that the slightly twisted portions at which the reversing point of the insulated conductors are pretwisted may not be placed close each other in adjacent side circuits of the resulting quads, thus increasing the capacitance unbalance between these portions.

Turning now to the twisting apparatus 13, the apparatus shown in the drawing has a well known construction, and comprises a U shaped frame 150 secured to the base 50, hollow rotary members 153 and 154 supported by the pillow blocks 151 and 152 of the U shaped frame 150 and a floating platform 156 rotatably supported by the inner ends of the rotary members 153 and 154. Drive pulleys 158 and 159 driven by a source of drive, not shown, and guide rollers 160 and 161 are mounted on the hollow rotary members 153 and 154, respectively. Further, a flyer 165 supported by supporting members 163 and 164 is disposed between the rotary members 153 and 154.

A convergence die 166 is disposed to the left of the rotary member 153 of the twisting apparatus 13 and a face plate 170 is mounted on an bracket 168 projecting from the lefthand leg of the U shaped frame 150. Although not shown in the drawing, the face plate 178 is provided with four perforations for distributing four insulated conductors sent from the pretwisting apparatus 12. To the left of the face plate 170 is provided a guide roller 172 which is rotatably supported by a bracket 171 secured to the bracket 168.

Drive pulley 159 and a plurality of slip rings 173 are mounted on the outer end of the rotary member 154 which projects beyond the pillow block 152 of the frame 150. Electric power supplied to the slip rings 173 from a source of supply, not shown, is supplied to the apparatus (to be described later) mounted on the floating platform 156 through brushes 174 cooperating with the slip rings 173, conductors (not shown) in the hollow rotary member 154 and slip rings 175 on the inner end of the rotary member 154. The floating platform 156 is provided with projections 176, 177 on the opposite ends thereof which are rotatably supported by the cup shaped flanges on the confronting ends of the rotary members 153 and 154 through bearings. A draw-off capstan 179 for drawing the insulated conductor is secured to a vertical shaft 178 rotatably supported by the floating platform 156. The draw-off capstan 179 is rotated by the rotation of the rotary member 154 through a suitable driving mechanism, not shown. Also a take up bobbin 182 is mounted on the floating platform 156, which is rotated in the direction indicated by an arrow by a source of drive 180 through a driving mechanism 183. Two traverser rollers 185 and 186 are rotatably mounted on a pedestal 184 secured to the floating platform 156. The traverser rollers 185 and 186 are reciprocated in a direction parallel to the axis of the take up bobbin 182 by the source of drive 180. An arm 187 extending in parallel with the rotary member 154 is secured to the righthand end of the floating platform 156 which is supported by the inner end of the rotary member 154 and the brushes 188 cooperating with the above described slip rings 175 are mounted on the right-hand end of the arm 187. The brushes 188 are connected to the source of drive 180 through suitable conductors, not shown.

The twisting apparatus 13 operates as follows. Four insulated conductors sent from the pretwisting apparatus 12 pass to the face plate 170 through the guide roller 172. Distributed insulated conductors are then gathered together by the convergence die 166. Then the gathered insulated conductors enter into the tubular rotary member 153. Then the gathered insulated conductors are brought to the outside of the rotary member 153 by guide roller 160 and hence to the guide roller 161 of the rotary member 154 via flyer 165. The gathered insulated conductors then are led into the rotary member 154 by the guide roller 161 are pulled by the draw-off capstan 179 on the floating platform 156 and wrapped several turns about the capstan 179. Thereafter the twisted insulated conductor is taken up by take up bobbin 182 via guide rollers 185 and 186. During the twisting operation, the rotary members 153 and 154 are rotated at a predetermined speed by a source of drive, not shown, through drive pulleys 158 and 159 thereby twisting the gathered conductors between the convergence die 166 and the guide roller 160 and between the guide roller 161 and the draw-off capstan 179 thus forming a star quad.

Having described the operation of various apparatuses of this invention, the operation of the entire apparatus will be briefly outlined as follows.

Four straight insulated conductors of the number necessary for forming a star quad are paid off from four stationary bobbins 21A through 21D of the pay-off apparatus 11 and supplied to the pretwisting apparatus 12 wherein the insulated conductors are fed into respective pretwisting devices 55 through 58 for providing four times pretwists to each insulated conductor. The portions of the insulated conductors pretwisted in this manner are shifted longitudinally with respect to each other via shift roller 141 such that the reversing points portions of respective insulated conductors are not co-extensive. The shifted insulated conductors are sent to the twisting apparatus 13 in which the four pretwisted insulated conductors are twisted with each other to form a star quad which is taken up by the take up bobbin 182.

Although in the illustrated example, the opposite ends of the pin 96 are supported by the confronting side walls of the rectangular frame 92, only one end of the pin may be supported by one of the side walls in which case the other side wall can be omitted.

Figure 5:
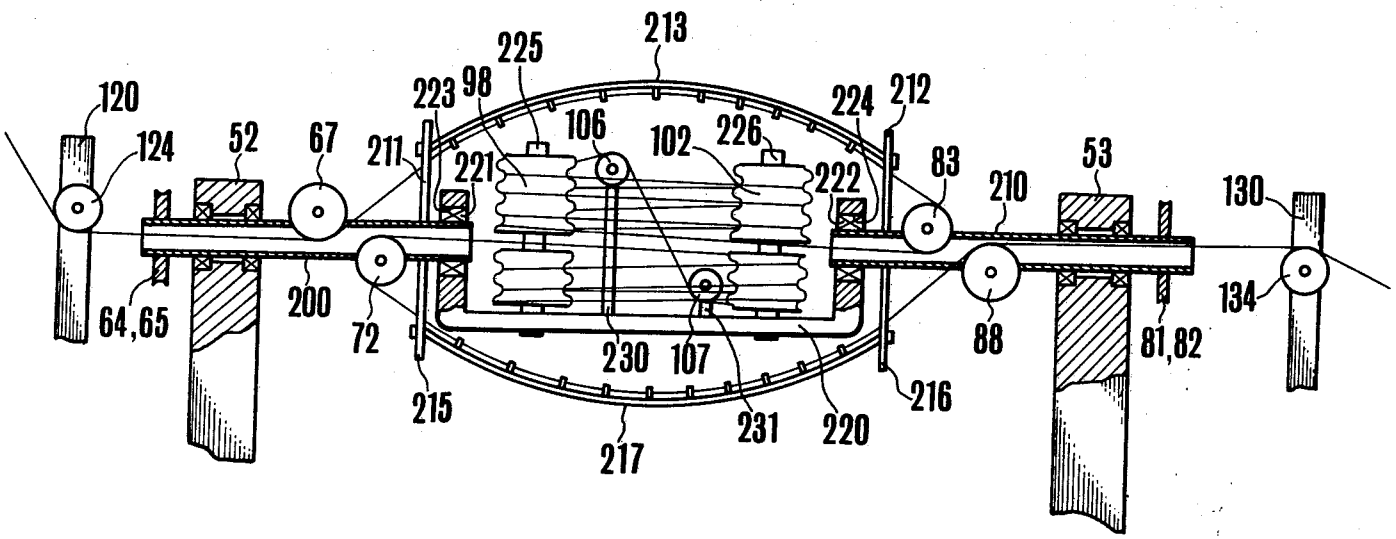
FIG. 5 is a longitudinal sectional view, partly removed, of another example of the twisting apparatus embodying the invention.

FIG. 5 shows a modified pretwisting device which is different from the embodiment shown in FIG. 3 in that in the case of FIG. 3 accumulating pulleys are mounted on horizontal shafts whereas in the case of FIG. 5 the accumulating pulleys are mounted on vertical shafts. Corresponding elements in both figures are designated by the same reference numerals.

The fore rotary member 200 takes the form of a tube rotatably supported by the pillow block 52 of the U shaped frame and the first guide roller 67 and the fourth guide roller 72 are mounted on the fore rotary member 200 on the portion thereof to the right of the pillow block 52 in the same manner as in the embodiment shown in FIG. 3. However, the second guide roller 69 shown in FIG. 3 is not used. The rear rotary member 210 has a construction similar to the fore rotary member 200. In other words, the rear rotary member 210 is provided with the third guide roller 83 and the sixth guide roller 88 but not with the fifth guide roller 86 shown in FIG. 3. Between the fore rotary member 200 and the rear rotary member 210 are disposed a flyer 213 supported by supporting members 211 and 212 and a flyer 217 supported by supporting members 215 and 216.

The floating platform 220 disposed between the fore and rear rotary members 200 and 210 takes the form of a letter U and the opposite legs of the floating platform 220 are provided with openings 223 and 224 for rotatably supporting the fore and rear rotary members. Fore accumulating pulleys 98 and rear accumulating pulleys 102 are rotatably mounted on spaced vertical shafts 225 and 226 secured to the upper surface of the floating platform. Deflection rollers 106 and 107 are mounted on supporting members 230 and 231 at desired heights between the accumulating pulleys 98 and 102.

The insulated conductors admitted into the tubular fore rotary member 200 through the inlet guide roller 124 is led to the outside of the fore rotary member 200 through the first guide roller 67, and then conveyed to the third guide roller 83 of the rear rotary member 210 via the flyer 213. The insulated conductor pulled into the hollow rear rotary member 210 through the third guide roller 83 is led to the fore accumulating pulleys 98 on the floating platform 220. The insulated conductor is passed several times about the rear and fore accumulating pulleys 102 and 98 and then passed about deflection rollers 106 and 107. Thereafter the insulated conductor is repeatedly passed about the rear and fore accumulating pulleys 102 and 98 and then drawn into the hollow fore rotary member 200 to reach the fourth guide roller 72. Then the insulated conductor is brought to the outside of the fore hollow member 200 and guided to the sixth guide roller 88 of the rear rotary member 210 via the flyer 217 to pass into the rear rotary member 210. Thereafter the insulated conductor is sent to the twisting apparatus 13 through outlet guide roller 134 mounted or the post 130 on the outlet side of the rear rotary member 210.

Under these conditions, when the fore and rear rotary members 200 and 210 are rotated synchronously in the same direction pretwists in the S and Z directions are applied to the insulated conductor between the inlet guide roller 124 on the inlet side of the fore rotary member 200 and the first guide roller 67, between the third guide roller 83 and the fore accumulating pulley 98, between the fore accumulating pulley 102 and the fourth guide roller 72 and between the sixth guide roller 88 and the outside guide roller 134 disposed on the outlet side of the rear rotary member at each revolution of the fore and rear rotary members 200 and 210. In this manner a total of four pretwists are formed as in the pretwisting device shown in FIG. 3.

Although in the embodiment shown in FIG. 1 the shafts 26 and 27 for the pay-off bobbins of the pay-off apparatus 11 are inclined with respect to the vertical it is also possible to cause the pay-off bobbins to rotate about horizontal shafts by rotating 90° the insulated conductor pay-off apparatus 11 from the position shown in FIG. 1. With such horizontal arrangement it is possible to prevent loosening of the insulated conductors wound upon the pay-off bobbins which occur when the pay-off bobbins are arranged vertically as shown in FIG. 1. Horizontal arrangement is advantageous especially when the insulated conductors are not tightly wound upon the bobbins. Furthermore, in this embodiment the guide rings 32 and 33 are shown to be frictionally driven by the insulated conductors paid off from the bobbins it also possible to drive these guide rings by suitable driving means. To this end, rotary shafts driven by the driving means are arranged in concentric with the stationary shafts 26 and 27.

Instead of mounting a shift roller 141 to the outlet side of the pretwisting devices 57 and 58 of the pretwisting apparatus 12, the shift roller may be positioned in other positions. The reason for providing the shift roller is that the reversing points of the S and Z twisted directions of the insulated conductors sent out from respective pretwisting devices 55 through 58 occupy the same positions along the length of the insulated conductors so that when the insulated conductors are twisted together into a quad the mutual capacitance between the two pairs in the quad may become unbalanced thus degrading the crosstalk characteristics of the cable. Such deterioration of the crosstalk characteristics can be readily prevented by merely shifting longitudinally two out of four reversing points on the insulated conductors that comprise a star quad. The reversing points on the insulated conductors to be shifted may be any ones of the four insulated conductors. It is also possible to shift respective reversing points on the insulated conductors by slightly different positions. Further, instead of mounting the shift roller 141 on the top of a post 140, it is possible to mount the shift roller in a different manner.

The method and apparatus for twisting insulated conductors of multiconductor communication cables into star quads described hereinabove have the following advantages.

1. Different from the prior art method and apparatus wherein the insulated conductors are twisted by the insulated conductor pay-off apparatus, according to this invention, since the advancing insulated conductors are twisted in the S and Z directions between the pay-off apparatus and the pretwisting apparatus, it is possible to twist and pretwist the insulated conductors at higher speeds without being restricted by other conditions.

2. According to this invention it is possible not only to readily vary the ratio of the number of pretwists to the pitch of twisting of the quad but also to increase the number or pretwists without decreasing the twisting speed so that it is possible to make more uniform the capacitance unbalance between two pairs in the star quad and hence to improve the crosstalk characteristics. In the illustrated embodiments since four pretwists are formed along an insulated conductor while the drive pulley makes one revolution it is possible to form four times the number of pretwists formed by the prior art method.

3. According to this invention, four insulated conductors constituting a quad are pretwisted, alternately in the S and Z directions, so as to prevent unequal mutual capacitance due to the maldistribution of the insulated conductors in the cross-section of the star quad, and thereafter the reversing position between the S and Z pretwisted directions of respective insulated conductors are shifted longitudinally so that it is possible to uniformly distribute the mutual capacitance along the length of the strand. Consequently, it is possible to better reduce the capacitance unbalance between two pairs in the star quad.

4. According to this invention, it is possible to fix the pay-off bobbins, thus making it possible to readily splice the leading end of the insulated conductor of the succeeding pay-off bobbin to the trailing end of the insulated conductor of the preceding pay-off bobbin while the twisting machine is operating. This enables continuous pay-off of a long insulated conductor, and to readily substitute a new pay-off bobbin for an empty bobbin.

5. Further, since it is not necessary to provide rotary flyers or a rotating turn table for the pay off bobbins, it is possible to increase the size or capacity of the pay-off bobbins.

While the invention has been shown and described in terms of its preferred embodiments it should be understood that many changes and modifications will be obvious to one skilled in the art without departing from the true spirit and scope of the invention as defined in the appended claims.

What is claimed is:

1. A twisting apparatus for twisting insulated conductor wire used in the manufacture of cables, comprising:

(a) a pay-off means including four bobbin holder sets each set comprising a pair of bobbins, guide means over each of said bobbin holders so that a spool with insulated conductor wire thereon on one of said pair can be idle and replaced while a spool on the other bobbin holder of said pair is paying off insulated conductor wire and when material from said other spool is exhausted, said one spool pays-off insulated conductor wire as said other spool is idle;

(b) pre-twisting means for providing S and Z direction twists to said insulated conductor wire comprising four pre-twisting units, each pre-twisting unit having a tubular fore rotary member and a tubular rear rotary member, means for driving said fore and rear rotary members at the same speed, means for periodically reversing the directions of rotations thereof at the same time, frame means for rotatably supporting said fore and rear rotary members on a straight line and in a spaced apart relationship, a floating platform disposed between said fore and rear rotary members to be rotatable relative thereto, said floating platform comprising two pairs of substantially rectangular plates, one of said pairs rotatably mounted to said fore rotary members, the other pair rotatably mounted to said rear rotary member, each plate of said pair of plates connected to each other by a pin member, said pin member extending substantially perpendicular to each plate, a connecting plate means for connecting the pair of plates mounted adjacent the fore rotary member to the pair of plates mounted adjacent the rear rotary members, a fore guide pulley centrally mounted between said pair of plates mounted to said fore rotary member on said pin member, a rear guide pulley centrally mounted between said pair of plates mounted to said rear rotary member on said pin member, a plurality of insulated conductor wire accumulating pulleys mounted on both sides of said fore and rear guide pulleys on both of said pin members, a pair of deflecting pulleys mounted to said connecting plate means, said deflecting pulleys having their axes of rotation perpendicular to said pin member, an inlet guide roller mounted on the inlet side of said fore rotary member, an outlet guide roller mounted on the outlet side of said rear rotary member, a plurality of guide means provided for said fore and rear rotary members and mounted thereon, means for passing an insulated conductor wire paid off from said pay-off means successively through said inlet guide roller, one guide means of said fore rotary member, one guide means of said rear rotary member, and from the rear guide means to the rear guide pulley, alternately around said front and rear accumulating pulleys on one side of said guide pulley, around said pair of deflecting pulleys, and alternately around said front and rear accumulating pulleys on the other side of said guide pulley, and then around said fore guide pulley, the other guide means of said fore rotary member, the other guide means of said rear rotary member and said outlet guide roller;

(d) a twisting means for receiving four insulted conductor wires from the pre-twisting means and twisting them into a star quad including a converging die receiving said pre-twisted insulated conductor wires, a tubular rotary member fed by said die, a flyer and a near and far end fed by said tubular rotary member at the near end and an end guide roller at the far end, a drive wheel within said flyer adapted to receive several turns of insulated conductor wire fed by said end guide roller;

(d) a take up bobbin in said flyer fed by said drive wheel for taking up the twisted star guad; and (e) said pretwisting means being operable independently of said twisting means to vary the number of pretwists provided to individual insulated conductor wires and to vary the ratio of the number of pretwists to the pitch of twisting of the resultant star quad whereby capacitance imbalance is made more uniform and cross-talk characteristics of the star quad optimized.

2. An apparatus according to claim 1, wherein said pretwisting apparatus includes a shift roller for dividing the wires pretwisted by said pretwisting devices into two groups, each of which constitutes a pair, and relatively shifting the reversing points of the wires of the respective groups in a direction so as not to be placed close to each other, said insulated conductors being pretwisted in S and Z directions at the reversing point.

3. An apparatus according to claim 1 wherein said fore rotary member is provided with a drive pulley on its outlet side of said rear rotary member is provided with a drive pulley on its inlet side and wherein a source of drive is provided for driving said drive pulleys and for periodically reversing the directions of rotations of said drive pulleys.

4. An apparatus according to claim 2 wherein said fore rotary member includes a tubular member and first, second and fourth guide rollers and said rear rotary member includes a tubular member and third, fifth and sixth guide rollers, whereby wire paid off from said pay-off means passes successively through said inlet guide roller, the interior of said tubular fore rotary member, about said frist guide roller to the outside of said fore rotary member, about said second guide roller, the third guide roller of said rear rotary member, the interior of said rear rotary member, said groups of the insulated conductor accumulating pulleys on said floating platform, the interior of said fore rotary member, about said fourth guide roller of said fore rotary member to the outside thereof, the fifth guide roller and the sixth guide roller of said rear rotary member into the inside thereof, and said outlet guide roller.

5. An apparatus according to claim 2 wherein each pair of pay-off bobbins are so disposed that the trailing end of the wire on one bobbin can be spliced to the leading end of the insulated conductor on the other bobbin and includes a pair of inclined bases, and a pair of shafts secured to said bases for supporting said bobbins, the extensions of the axes of said shafts intersecting with each other at a point.

6. An apparatus according to claim 5 wherein the axes of said shafts are contained in a vertical plane.

7. An apparatus according to claim 1 wherein accumulating pulleys are mounted on horizontal shafts extending between side frames of said floating frame.

8. An apparatus as claimed in claim 1 wherein said guide means comprises a pair of conical shaped hoods (35, 36) over each of said bobbin holders, each of said pair of hoods having a communicating passage (37).

9. An apparatus as claimed in claim 1, said twisting means (13) receiving four insulated conductors from the pretwisting means including a face plate (170) receiving four conductors, said converging die (166) receiving said conductor from said face plate.

10. Apparatus for twisting insulated conductors for use in multiconductor communication cables into star quad, which comprises insulated conductor pay-off apparatus including four sets of stationary pay-off bobbins respectively wound with respective individual strands of insulated conductor, pretwisting apparatus for applying pretwists to the respective and individual strands of insulated conductor paid off from said pay-off bobbins alternately in S and Z directions, and twisting apparatus for twisting together into a quad the individual strands of insulated conductor pretwisted by said pretwisting apparatus, said pretwisting apparatus including four pretwisting device, each of which comprises a tubular fore rotary member and a tubular rear rotary member, means for driving said fore and rear rotary members at the same speed and for periodically reversing the direction of rotation thereof simultaneously, frame means for rotatably supporting said fore and rear rotary members in a straight line and in spaced apart relationship, a floating platform journaled between said fore and rear rotary members and floatingly fixed in space relative to said fore and rear rotary members, a plurality of groups of insulated conductor accumulating pulleys mounted on said floating platform whereby lengths of a pretwisted insulated conductor strand up to 50 meters may be accumulated, an inlet guide roller mounted on said frame means on an inlet side of said fore rotary member, an outlet guide roller mounted on said frame means on an outlet side of said rear rotary member, at least two guide members mounted on and rotatable with each of said fore and rear rotary members, whereby an individual strand of insulated conductor paid off from a respective pay-off bobbin passes successively through said inlet guide roller, one guide member of said fore rotary member, one guide member of said rear rotary member, said groups of said insulated conductor accumulateing pulleys on said floating platform, the other guide member of said fore rotary member, the other guide member of said rear rotary member and thence through said outlet guide roller to the twisting apparatus, said pretwisting apparatus being operable independently of said twisting apparatus to vary the number of pretwists provided to individual strands of insulated conductor and to vary the ratio of the number of pretwists to the pitch of twisting of the resultant star quad whereby capacitance unbalance is made more uniform and cross-talk characteristics of the star guad optimized.

11. The apparatus according to claim 10 wherein said pretwisting apparatus further includes a shift roller means for dividing the insulated conductors pretwisted by said pretwisting devices into two groups, each of which constitutes a pair, and relatively shifting the reversing points of the insulated conductors of respective groups in a direction so as not to be placed close each other, said insulated conductors being pretwisted in the directions of S and Z at the reversing point.

12. The apparatus according to claim 10 wherein said insulated conductor pay-off apparatus comprises four insulated conductor pay-off devices each including a stationary bobbin wound with an insulated conductor to be paid off.

13. The apparatus according to claim 10 wherein said driving means comprises a first pulley provided on the inlet side of said fore rotary member, a second drive pulley on the outlet side of said rear rotary member and a source of drive for driving said drive pulleys and for periodically reversing the directions of rotation of said drive pulleys.

14. The apparatus according to claim 10 wherein said plurality of insulated conductor accumulating pulleys mounted on said floating platform comprises a fore group of the insulated conductor accumulating pulleys and a rear group of the insulated conductor accumulating pulleys, and wherein deflection rollers are disposed between said groups, whereby an insulated conductor passes successively through one guide member of said rear rotary member, said fore group of the insulated conductor accumulating pulley, several times around said insulated conductor accumulating pulleys of said fore and rear groups, said deflection rollers, several times again around said insulated conductor accumulating pulleys of said fore and rear groups, and finally the other guide member of said fore rotary member.

15. The apparatus according to claim 11 wherein said fore rotary member comprises first, second an fourth guide rollers and said rear rotary member comprises third, fifth and sixth guide rollers, whereby an insulated conductor paid off from said insulated conductor pay-off apparatus passes successively through said inlet guide roller, the interior of said tubular fore rotary member, about said first guide roller to the outside of said fore rotary member, about said second guide roller, the third guide roller of said rear rotary member, the interior of said rear rotary member, said groups of the insulated conductor accumulating pulleys on said floating platform, the interior of said fore rotary member, about said fourth guide roller of said fore rotary member to the outside thereof, the fifth guide roller and the sixth guide roller of said rear rotary member into the inside thereof, and said outlet guide roller.

16. The apparatus according to claim 11 wherein said fore rotary member comprises first and third guide members and said rear rotary member comprises second and fourth guide members and wherein first and second rotary flyers are disposed between said fore and rear rotary members, whereby an insulated conductor paid off from said insulated conductor pay-off apparatus passes successively through said inlet guide roller, the interior of said tubular fore rotary member, about said first guide member of said fore rotary member to the outside thereof, said first rotary flyer, about said second guide member of said rear rotary member into the interior thereof, several times about the pulleys of said groups of insulated conductor accumulation, the interior of said fore rotary member, about said third guide member of said fore rotary guide member to the outside thereof, said second rotary flyer, about said fourth guide member of said rear rotary member into the inside thereof, and said outlet guide roller.

17. The apparatus according to claim 10 wherein each insulated conductor pay-off device comprises at least two pay-off bobbins, the trailing end of the insulated conductor or one bobbin being spliced to the leading end of the insulated conductor on the other bobbin, a pair of inclined bases, and a pair of shafts secured to said bases for supporting said bobins, the extensions of the axes of said shafts intersecting with each other at a point.

18. The apparatus according to claim 17 wherein the axes of said shafts are contained in a vertical plane.

19. The apparatus according to claim 17 wherein the axes of said shafts are contained in a horizontal plane.

20. The apparatus according to claim 10 wherein said floating platform is provided with a weight.

21. The apparatus according to claim 10 wherein said plurality of groups of insulated conductor accumulating pulleys are mounted on horizontal shafts extending between side frames of said floating platform.

22. The apparatus according to claim 10 wherein said plurality of groups of insulated conductor accumulating pulleys are mounted on vertical shafts secured on the upper surface of said floating platform.

* * * * *